US005998120A

United States Patent [19]

Connelly et al.

[11] Patent Number: 5,998,120

[45] Date of Patent: Dec. 7, 1999

[54] PROCESS FOR MAKING A DIRECT DISPERSION OF A PHOTOGRAPHICALLY USEFUL MATERIAL

[75] Inventors: Richard W. Connelly, Rochester; James S. Honan, Spencerport, both of N.Y.; Andrew M. Howe, Watford, United Kingdom

[73] Assignee: Eastman Kodak Company, Rochester, N.Y.

[21] Appl. No.: 09/000,597

[22] Filed: Dec. 30, 1997

[51] Int. Cl.[6] ..... G03C 1/047

[52] U.S. Cl. ..... 430/539; 430/642; 430/546; 430/631; 430/354

[58] Field of Search ..... 430/449, 546, 430/642, 539, 631; 530/354

[56] References Cited

U.S. PATENT DOCUMENTS

| | | | |
|---|---|---|---|
| 3,551,151 | 12/1970 | Malan | 430/642 |
| 4,146,398 | 3/1979 | Arase et al. | 430/449 |
| 4,266,010 | 5/1981 | Nagatomo et al. | 430/365 |
| 4,510,228 | 4/1985 | Tsubai et al. | 430/642 |
| 4,830,948 | 5/1989 | Ishikawa et al. | 430/372 |
| 5,187,259 | 2/1993 | Sterman et al. | 530/354 |
| 5,206,120 | 4/1993 | Hayashi | 430/376 |
| 5,378,598 | 1/1995 | Bagchi et al. | 430/569 |
| 5,399,480 | 3/1995 | Whitson et al. | 430/642 |
| 5,589,322 | 12/1996 | Lobo et al. | 430/449 |
| 5,594,047 | 1/1997 | Nielsen et al. | 523/315 |
| 5,731,134 | 3/1998 | Honan et al. | 430/449 |
| 5,763,150 | 6/1998 | Pitt et al. | 430/546 |

FOREIGN PATENT DOCUMENTS

| | | |
|---|---|---|
| 0695968 A2 | 2/1996 | European Pat. Off. . |
| 92/01971 | 2/1992 | WIPO . |

*Primary Examiner*—Janet Baxter
*Assistant Examiner*—Amanda C. Walke
*Attorney, Agent, or Firm*—Andrew J. Anderson

[57] ABSTRACT

A process for making a direct dispersion of a photographically useful material is discloses comprising: mixing (i) an aqueous phase comprising a gelatin solution and (ii) a liquid organic phase comprising a photographically useful material under conditions of high shear or turbulence to form a fine dispersion of the organic phase having an average particle size of less than 0.5 micron dispersed in the aqueous phase; wherein the gelatin solution comprises a mixture of a first gelatin having an isoelectric point pH of less than or equal to 5.2 and a second gelatin having an isoelectric point pH of greater than or equal to 6.0. In accordance with the invention, the use of blends of a first gelatin having an pI of less than or equal to 5.2, such as a conventional lime processed gelatin, and a second gelatin having an pI of greater than or equal to 6.0, such as an acid processed gelatin, in a direct photographic dispersion yields a substantial reduction in viscosity in comparison to the use of the first gelatin alone, which reduction is greater than would be expected by just using blends of the first gelatin with another relatively low pI gelatin having an equivalent inherent viscosity as the second gelatin. In accordance with preferred embodiments of the invention, relatively low levels of APO gelatin may be used partially replacing LPO gelatin in a dispersion formulation to obtain significant viscosity reduction while minimizing adverse effects which may be associated with the use of higher levels of acid processed gelatin.

24 Claims, No Drawings

PROCESS FOR MAKING A DIRECT DISPERSION OF A PHOTOGRAPHICALLY USEFUL MATERIAL

FIELD OF THE INVENTION

This invention relates to methods of making dispersions of photographically useful materials in aqueous solutions. More particularly this invention relates to a process of making a fine photographic direct dispersion in an aqueous gelatin solution comprising a blend of gelatin types and in the absence of auxiliary solvents.

BACKGROUND OF THE INVENTION

The use of aqueous dispersions of photographic couplers and other hydrophobic photographically useful compounds is known in the art. Generally, dispersions of hydrophobic photographically useful materials (PUMs) in aqueous solutions are prepared by one of the following ways: milling of solid particles using the well known methods of comminution; precipitation of photographically useful materials from solution; and homogenization of a liquid organic phase containing a photographically useful material into an aqueous solution containing a hydrophilic colloid such as gelatin and, optionally, a surface active material.

Processes for homogenization of liquid organic phases frequently include the use of low boiling or at least partially water miscible auxiliary solvents, which auxiliary solvent is subsequently removed after homogenization by evaporating volatile solvent or washing water miscible solvents. Such auxiliary solvents facilitate combining couplers and/or any other hydrophobic dispersion components in a mixed solution, so that a dispersion with an oil phase of uniform composition is obtained. The solvent also lowers the viscosity of the oil solution, which allows the preparation of small-particle emulsified dispersions. The use of auxiliary solvent may also be used to form a liquid organic solution of a PUM for forming a dispersion where no permanent solvent is desired in the final dispersion. However, the use of auxiliary solvent also presents several difficulties in the preparation of photographic dispersions and elements. Auxiliary solvents can cause severe coating defects if not removed before the coating operation. Also, it is not possible, due to thermodynamic considerations, to remove 100% of the auxiliary solvent from the dispersion. This may cause other deleterious effects such as enhancing the solubility and movement of the PUM, or aid in crystallization. Further, the steps of evaporating volatile solvent from an evaporated dispersion and washing a chill-set, washed dispersion often leads to final photographic dispersions with variable concentration, so that careful analysis is necessary to determine the actual concentration of the photographically useful compound in the dispersion. Volatile or water-soluble auxiliary solvents present health, safety, and environmental hazards, with risks of exposure, fire, and contamination of air and water. The cost can be significant for the solvent itself, as can be the costs of environmental and safety controls, solvent recovery, and solvent disposal.

Alternatively, PUMs may be "directly" homogenized or dispersed into an aqueous solution in the substantial absence of any auxiliary solvent (i.e., absence of such solvents beyond trace or impurity levels). In one such direct dispersion process, the hydrophobic components desired in the dispersion, e.g., coupler and permanent coupler solvent, are simply melted at a temperature sufficient to obtain a homogeneous oil solution. This is then emulsified or dispersed in an aqueous phase, typically containing gelatin and surfactant. The direct process also yields a dispersion with a known concentration of the photographically useful compound, based on the components added, with no variability due to evaporation or washing steps. No volatile or water-soluble organic solvents are needed, eliminating the hazards and costs associated with their use. Additionally, the absence of auxiliary solvents in the dispersion forming step generally allows for higher concentrations of permanent organic phase (comprising the photographically useful materials and any high boiling permanent organic solvent) in the resulting dispersion.

While the direct dispersion process may be preferred for the above reasons, direct dispersion formulations may result in dispersion viscosities which may be higher than desired, especially where relatively high permanent organic phase concentrations are employed (e.g., above 16 weight percent). Such high viscosities may cause difficulty in pumping and filtering, e.g., which may lead to higher waste. Where the dispersion viscosity limits the viscosity of a photographic layer coating composition, subsequent operations for coating the dispersion, deaeration and the coating process itself may be adversely affected. It is typical to manage this viscosity by diluting the dispersion. Increased amounts of water in a coating are undesirable, however, because drying the coating may be more difficult. While lower dispersion viscosities are desirable for ease in pumping, filtration, dearation, coating and drying, they are generally difficult to achieve at high organic phase concentrations.

As indicated above, the aqueous phase of direct dispersions typically contain gelatin. Gelatin used in forming photographic dispersions and elements is available in various forms such as alkali-treated gelatin, acid-treated gelatin, and gelatin derivatives manufactured by treating or reforming gelatin in various ways. Such gelatins generally have an average molecular weight of from tens of thousands to several hundred thousands, as determined by terminal group analysis, amino acid composition analysis, light scattering, gel permeation, ultracentrifuging, or surface pressure measurement. Dispersion viscosity is a function of the size and concentration of the gelatin molecules employed in the dispersion. The viscosity of gelatin solutions is particularly sensitive to the fraction of the gelatin molecules which have a molecular weight greater than 150,000, which typically constitute the $\gamma$ fragment and microgel fragment of hydrolyzed collagen (from which gelatin is obtained). Cattle (cow) bones are the principal starting material for gelatin typically used in photographic elements. While cattle and pig skins may also be also be used, skin gelatins usually contain photographically active components, and their uses in photographic systems are therefore limited.

The manufacture of gelatin involves several stages. The first step is the deashing process to reduce the calcium (mainly calcium triphosphate or calcium apatite and calcium carbonate) content of the bones through a soak for about a week in a mineral acid bath. This decalcified material is referred to as collagen or "ossein." Collagen or the ossein is a crosslinked and structured polypeptide which is further treated either by lime or by a mineral acid to hydrolyze and denature the tertiary, secondary and partly the primary structures to produce water-soluble gelatin. During the formation of gelatin collagen, which is composed of crosslinked triple helices of $\alpha 1$ and $\alpha 2$ chains (MW=285,000), is first denatured to the randomly coiled $\lambda$ form, then to a mixture of the $\gamma 11$ (composed of two $\alpha 1$ chains MW=190,000), $\gamma 12$ (composed of one $\alpha 1$ and one $\alpha 2$ chain, MW=190,000), and to single $\alpha 1$ and $\alpha 2$ stands (MW=95,000) and sub-alpha fragments (MW<95,000). The solubilized gelatin fractions are leached and, for many applications, deionized by passage through ion exchange beds, chilled, noodled, and then dried for storage. Lime processing to produce gelatin requires between 2 to 3 months of treatment, whereas acid treatment usually requires only several days. Consequently acid processing is typically less expensive than lime processing and thus economically attractive. As acid hydrolysis occurs more rapidly, however, it is less controllable, and typically leads to gelatins that usually have much lower average molecular weights than those derived from lime treatment. Conventional lime processed ossein gelatin typically used in photographic materials usually contains greater than 40% by weight of molecules having a molecular weight greater than 150,000 daltons, as measured by size exclusion chromatography. While relatively lower molecular weight lime processed gelatins are also available (e.g., gelatins having less than 40% by weight of molecules having a molecular weight of greater than 150,000), such gelatins have found limited use in photographic elements due to their resulting physical properties. Acid processed ossein and pigskin gelatins typically contain less than 35% by weight of such high molecular weight molecules.

The physical properties of gelatin, such as the isoelectric point (designated pI, which is the pH at which the gelatin exhibits a neutral charge), molecular weight and molecular weight distribution depend upon the nature of the processing, such as lime or acid, as discussed above. It has generally been noted that the pI of lime processed ossein (LPO) gelatin is typically in the range of pH 4.8–5.1, while that of acid processed pigskin (APP) gelatin is typically much higher at around pH 9. Acid processed ossein (APO) gelatins typically exhibit higher pI values than lime processed gelatins, but typically not as high as acid processed pigskin gelatin, e.g., in the range of 6.0–8.0. While the use of acid processed gelatins in photographic dispersions and elements would offer a cost advantage, they generally exhibit lower than desired molecular weights for photographic use, as reducing the MW of gelatin can lead to undesirable photographic element layer coating properties. Also, it has been found that pure APO gelatin in concentrated dispersions leads to viscosity increases with time at standard operating temperatures, which situation can complicate manufacturing conditions, such as requiring dilution of the dispersion or increased operating temperatures. Such practices may result in undesired increased wet load, lower throughput, coating nonuniformity and chemical instability.

PROBLEMS TO BE SOLVED

It would be desirable to provide a process for making a concentrated direct dispersion of a photographically useful material in an aqueous gelatin solution having a reduced viscosity, preferably where higher temperatures or dilutions for managing viscosity increase with time are not necessarily employed. It would be further desirable to provide such a process which does not significantly degrade the physical properties of photographic dispersions and elements containing such dispersions.

SUMMARY OF THE INVENTION

These and other objectives are achieved in accordance with the process of the invention, which comprises a process for making a direct dispersion of a photographically useful material comprising: mixing (i) an aqueous phase comprising a gelatin solution and (ii) a liquid organic phase comprising a photographically useful material under conditions of high shear or turbulence to form a fine dispersion of the organic phase having an average particle size of less than 0.5 micron dispersed in the aqueous phase; wherein the gelatin solution comprises a mixture of a first gelatin having an isoelectric point pH of less than or equal to 5.2 and a second gelatin having an isoelectric point pH of greater than or equal to 6.0.

In accordance with the invention, we have found that the use of blends of a first gelatin having an pI of less than or equal to 5.2, such as a conventional lime processed gelatin, and a second gelatin having an pI of greater than or equal to 6.0, such as an acid processed gelatin, in a direct photographic dispersion yields a substantial reduction in viscosity in comparison to the use of the first gelatin alone, which reduction is greater than would be expected by just using blends of the first gelatin with another relatively low pI gelatin having an equivalent solution viscosity as the second gelatin. In accordance with preferred embodiments of the invention, relatively low levels of APO gelatin may be used partially replacing LPO gelatin in a dispersion formulation to obtain significant viscosity reduction while minimizing adverse effects which may be associated with the use of higher levels of acid processed gelatin.

DETAILED DESCRIPTION OF THE INVENTION

The process of the invention is generally applicable to forming aqueous dispersions of hydrophobic photographically useful materials (PUMs) which may be used at various locations throughout a photographic element. Dispersions formed in accordance with the invention may be used in single color (including black and white) or multicolor photographic elements. Multicolor elements typically contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

Photographically useful materials which may be dispersed in accordance with the invention include photographic couplers (including yellow, magenta and cyan image-forming couplers, colored or masking couplers, inhibitor-releasing couplers, and bleach accelerator-releasing couplers, dye-releasing couplers, etc.), UV absorbers, preformed dyes (including filter dyes), high-boiling organic solvents, reducing agents (including oxidized developer scavengers and nucleators), stabilizers (including image stabilizers, stain-control agents, and developer scavengers), developing agents, development boosters, development inhibitors and development moderators, optical brighteners, lubricants, etc. After formation of a dispersion in accordance with the invention, the resulting dispersion may be incorporated in a photographic coating layer in accordance with known practices.

In the following discussion of suitable materials for use in the dispersions of the invention and photographic elements that can be used in conjunction with such dispersions, reference will be made to *Research Disclosure*, September 1994, Item 36544, published by Kenneth Mason Publications, Ltd., Dudley House, 12 North Street, Emsworth, Hampshire P010 7DQ, ENGLAND, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

Silver halide emulsions employed in photographic elements can be either negative-working or positive-working. Silver halide emulsions suitable for use in elements comprising dispersions formed in accordance with the invention, and their preparation as well as methods of chemical and spectral sensitization, are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

In practicing the present invention, a hydrophobic PUM is melted by heat or dissolved in an organic solvent prior to homogenization. Materials that have a relatively low melting point, e.g. below 90° C., can be dispersed without the use of organic solvents. The molten mixture of the PUM with or without the permanent solvent is termed the liquid organic (or oil) phase.

Where the liquid organic phase includes an organic solvent, it is preferred to use high-boiling or permanent organic solvents. High boiling solvents have a boiling point sufficiently high, generally above 150° C. at atmospheric pressure, such that they are not evaporated under normal dispersion making and photographic layer coating procedures. Non-limiting examples of high boiling organic solvents that may be used include the following.

| | |
|---|---|
| S-1 | Dibutyl phthalate |
| S-2 | Tritolyl phosphate |
| S-3 | N,N-Diethyldodecanamide |
| S-4 | Tris(2-ethylhexyl)phosphate |
| S-5 | Octyl oleate monoepoxide |
| S-6 | 2,5-Di-t-pentylphenol |
| S-7 | Acetyl tributyl citrate |
| S-8 | 1,4-Cyclohexylenedimethylene bis(2-ethylhexanoate) |
| S-9 | Bis(2-ethylhexyl)phthalate |
| S-10 | 2-phenylethyl benzoate |
| S-11 | Dibutyl sebacate |
| S-12 | N,N-Dibutyldodecanamide |
| S-13 | Oleylalcohol |
| S-14 | 2-(2-Butoxyethoxy)ethyl acetate |

It is an advantage of the process of the invention that auxiliary solvents are not essential for forming fine dispersions, and it is preferred that direct dispersions are prepared wherein essentially no volatile or water-miscible organic solvent is present in the organic phase. In accordance with particularly preferred embodiments, such direct dispersions may be prepared where the organic phase comprises at least 16 weight percent, more preferably at least 17 weight percent, and most preferably at least 18 weight percent, of the dispersion even in the absence of auxiliary solvents. Inclusion of such solvents in photographic elements, however, may be desirable in certain situations to achieve photographic properties not directly related to the dispersion making process, and their presence will not interfere with the process of the invention. Most useful auxiliary solvents are water immiscible, volatile solvents, and solvents with limited water solubility which are not completely water miscible. Non-limiting examples of these include the following.

| | |
|---|---|
| A-1 | Ethyl acetate |
| A-2 | Cyclohexanone |
| A-3 | 4-Methyl-2-pentanol |
| A-4 | Triethyl phosphate |
| A-5 | Methylene chloride |
| A-6 | Tetrahydrofuran |

The aqueous phase of the dispersions of the invention comprises a mixture of at least two distinct gelatins, the first of which has an pI of less than or equal to 5.2, preferably from 4.8–5.1, and most preferably about 4.9–5.0, and the second of which has an pI of greater than or equal to 6.0, preferably from 6.0–9.5, more preferably from 6.0–8.0, and most preferably about 6.0–7.5. The first gelatin preferably comprises a lime processed ossein (LPO) gelatin which exhibits a solution viscosity of at least 4.0 cP, more preferably at least about 7.0 cP and most preferably at least about 12.0 cP, wherein the solution viscosity of the gelatin is measured as a 10 wt % aqueous solution at a temperature of 45° C. and a pH of 5.7, as the invention is particularly useful for decreasing dispersion viscosity while maintaining the physical advantages provided by the use of higher viscosity gelatins. The most preferred LPO gelatins for use in accordance with the invention are typically distinguished from lower viscosity gelatins in that they contain greater than 40% by weight of molecules having a molecular weight greater than 150,000 daltons. Lime processed gelatins may contain a significant calcium ion concentration (e.g., typically about 3000 ppm), or may be deionized to result in much lower calcium concentrations. Dispersions obtained in accordance with the invention are particularly useful wherein the first gelatin comprises a decalcified lime processed ossein gelatin, as such gelatins typically result in relatively higher dispersion viscosities. The second gelatin preferably comprises an acid processed gelatin which exhibits a solution viscosity of less than or equal to about 150%, and more preferably less than or equal to about 100%, of the first gelatin solution viscosity, wherein the solution viscosity of each gelatin is measured as 10 wt % aqueous solutions at a temperature of 45° C. and a pH of 5.7, in order to optimize the dispersion viscosity reducing advantages in accordance with the invention. The second gelatin is most preferably an acid processed ossein (APO) gelatin having an pI of from 6.0–7.5. The total amount of gelatin in the dispersions of the invention may be typically used at levels up to 30 wt % based on the total amount of the aqueous phase, more preferably from 3–25 wt %, and most preferably 5–20 wt %.

The weight ratio of the first gelatin to the second gelatin in the dispersions of the invention is preferably from about 1:3 to 20:1, more preferably from about 1:1 to 10:1, and most preferably from about 1:1 to 3:1. Dispersions prepared in accordance with the invention employing a second gelatin having a substantially higher pI value than the first gelatin have been found to exhibit lower viscosities than are obtained by mixing an equivalent amount of a second gelatin having an equivalent solution viscosity as measured in a 10 wt % aqueous solution but which does not have a distinct pI value as required by the invention. This allows relatively low dispersion viscosities to be obtained while using only a fraction of a higher pI value second gelatin, thus avoiding undesirable effects which may be associated with the use of high levels of such high pI gelatins. In many cases, dispersions prepared using only a minor fraction of the relatively high pI value second gelatin in accordance with the invention exhibit viscosities which are comparable to, or even lower than, those obtained for dispersions employing an equivalent amount of only the high pI value gelatin, while substantially retaining the benefits supplied by a major fraction of the relatively low pI value first gelatin. In accordance with such embodiments of the invention, the relatively high pI value second gelatin thus preferably comprises less than 50 weight percent of the total gelatin, most preferably from about 10–45 weight percent of the total gelatin.

It is preferable to include surfactants in the aqueous solution. The surfactant is preferably an anionic or nonionic surfactant, including fluorosurfactants. For purposes of this invention, a surfactant is a surface active material which is capable of depressing the surface tension of distilled water by at least 20 dynes/cm at its critical micelle concentration at 25° C. Anionic surface active agents preferably have the $—SO_3^-$ or $—OSO_3^-$ moiety. Preferred anionic surface active agents include naphthalenesulfonic acids, sulfosuccinic acids, alkylbenzenesulfonic acids, alylsulfonates, alkylsulfates and alkylbenzenesulfonates. Preferred non-ionic surface active agents include polyol compounds, and compounds of the formula $$R—O—(CH_2CH_2O)_nH$$

where R is alkyl, aryl or aralkyl and n is from 5 to 30. A suitable amount of the surface active agent is up to 50% based on the gelatin used, preferably up to 20% and most preferably up to 10%. The aqueous solution containing the gelatin and any surfactant is termed the aqueous phase of the dispersion. Ratios of surfactant to liquid organic phase solution typically are in the range of 0.5 to 25 wt. % for forming small particle photographic dispersions, which ratios are also useful for the invention dispersions.

Dispersions in accordance with the invention may also contain further components conventionally employed in photographic dispersions. It is specifically contemplated to employ, e.g., polymer latex particles such as described in U.S. Pat. No. 5,594,047 and copending, commonly assigned application U.S. Ser. No. 08/605,237 filed Feb. 9, 1996, and references cited therein, the disclosures of which are incorporated by reference herein. Use of gelatin blends in accordance with the invention is particularly useful where small particle latex dispersions are used, as addition of such latexes may result in high dispersion viscosities.

Devices suitable for the high-shear or turbulent mixing of the dispersions of the invention include those generally suitable for preparing submicron photographic emulsified dispersions. These include but are not limited to blade mixers, colloid mills, homogenizer devices in which a liquid stream is pumped at high pressure through an orifice or interaction chamber, sonication, Gaulin mills, homogenizers, blenders, microfluidizers, rotor stator devices, etc. More than one type of device may be used to prepare the dispersions. For the purposes of this invention, "high shear or turbulent conditions" defines shear and turbulence conditions sufficient to generate a small particle conventional photographic dispersion with an average particle size of less than about 0.5 micron.

Factors that affect organic phase particle size in a photographic dispersion include homogenizer power, interfacial tension, and viscosity of the water phase relative to the liquid organic phase. Increases in homogenizer power can be used to decrease dispersion particle size, but the effect is limited by process hardware. Interfacial tension can be lowered to decrease dispersion particle size by increasing the level of surface active material. However, the interfacial tension obtainable with a given surface active material levels off to a lower limit beyond the critical micelle concentration of the surfactant. It has also been found that lowering the interfacial tension has a minimal effect on reducing particle size when the oil viscosity is high. Additionally, it is not desirable to have large amounts of surface active materials, because it creates problems during coating of photographic layers of a photographic element as well as the propensity of PUMs to grow crystals during storage of dispersions.

In accordance with preferred embodiments, the process of the invention is used to form aqueous dispersion of image dye-forming couplers. Couplers that form cyan dyes upon reaction with oxidized color developing agents include those described in such representative patents and publications as: U.S. Pat. No. 2,772,162; 2,895,826; 3,002,836; 3,034,892; 2,474,293; 2,423,730; 2,367,531; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent include those described in such representative patents and publications as: U.S. Pat. Nos. 2,600,788; 2,369,489; 2,343,703; 2,311,082; 3,152,896; 3,519,429; 3,062,653; 2,908,573 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent include those described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. In a preferred embodiment of the invention, an acetanilide yellow coupler is used which has the formula:

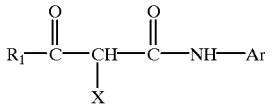

wherein $R_1$ is an alkyl, aryl, anilino, alkylamino or heterocyclic group; Ar is an aryl group; and X is hydrogen or a coupling-off group. The $R_1$, Ar and X groups may each contain further substituents as is well known in the art. In particularly preferred embodiments of the invention a pivaloylacetanilide yellow coupler is used wherein $R_1$ is t-butyl.

Ar is preferably substituted phenyl wherein at least one substituent is halo, alkoxy or aryloxy. Ar preferably additionally contains a ballasting group. Ballasting groups usually comprise one or more organic moieties containing 5 to 25 carbon atoms whose function is to immobilize the coupler and the formed image dye during photographic development by imparting poor water diffusibility to the coupler compound.

Coupling-off groups are generally organic groups which are released during photographic processing. The released coupling-off group can be a photographically useful group. Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

Generally the presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. No. 2,455,169; 3,227,551; 3,432,521; 3,476,563; 3,617,291; 3,880,661; 4,052,212; and 4,134,766; and in U.K. Patents and published application Nos. 1,466,728, 1,531,927, 1,533,039, 2,006,755A and 2,017,704A, the disclosures of which are incorporated herein by reference.

Dispersions of the invention are preferably used in a typical multicolor photographic element, which may comprise a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Such an element can contain additional layers, such as filter layers, interlayers, overcoat layers, subbing layers, and the like, containing dispersions prepared in accordance with the invention.

If desired, the photographic element can be used in conjunction with an applied magnetic layer as described in *Research Disclosure*, November 1992, Item 34390 published by Kenneth Mason Publications, Ltd., Dudley House, 12 North Street, Emsworth, Hampshire P010 7DQ, ENGLAND. It is further contemplated that the dispersions of the invention may also be advantageously used with the materials and processes described in an article titled "Typical and Preferred Color Paper, Color Negative, and Color Reversal Photographic Elements and Processing," published in *Research Disclosure*, February 1995, Volume 370.

The method of practicing the present invention and the above mentioned benefits are demonstrated in the following illustrative examples, wherein the following gelatins described in Table I were used:

The low shear viscosity $\eta(0)$ reported for each dispersion in the examples was measured at 50° C. using a controlled-strain Rheometrics Fluids Spectrometer with a couette measuring geometry. The shear viscosity was measured over a range of shear rates from 0.1 to 1000 1/sec. $\eta(0)$ is the viscosity of the dispersion at 50° C. extrapolated to zero shear.

Dispersion viscosity was also measured at a constant low applied frequency of 1 rad/sec, and the temperature of the sample was reduced in increments of 2° C. from a starting temperature of 50° C. The viscosity is generally stable over time at higher temperatures, but at some lower temperature the observation of an increase in viscosity with time is made, and is defined herein as the "Take-Off Temperature" or TOT.

Dispersed organic phase (comprising coupler and coupler solvent) particle size measurements were made in the examples by measuring the turbidity of the dispersion sample at a known dilution using near-infrared light. The mean dispersion particle size was related to turbidity by the theory of light scattering of colloidal particles. Samples with known particle size are used to calibrate the instrument. Particle sizes (Dnirt)that are reported are mean sizes which are related to the weight average particle size.

TABLE I

| Gelatin | Description | pI | Molecular Weight Distribution (wt %) | $\eta_G$ (cP) (10 wt % gelatin aqueous solution at T = 45° C., pH = 5.7 |
|---|---|---|---|---|
| A | High MW decalcified regular LPO gelatin | 4.9 | 24% >250K<br>18.4% 150–250K<br>45.0% 50–150K<br>11.9% < 50K | 18.6 |
| B | Low MW decalcified regular LPO gelatin | 4.9 | 11.1% > 250K<br>14.9% 150–250K<br>50.7% 50–150K<br>23.3% < 50K | 9.7 |
| C | Very low MW decalcified clarified LPO gelatin | 4.9 | 8.9% > 250K<br>14.0% 150–250K<br>38.4% 50–150K<br>38.7% < 50K | 7.8 |
| D | Low MW APO gelatin | 6.7 | 17.7% > 250K<br>15.0% 150–250K<br>33.8% 50–150K<br>33.5% < 50K | 10.0 |

Gelatin A is a conventional photographic lime processed gelatin. Gelatins B and C are lower viscosity lime processed gelatins obtained in earlier 5 extractions in the gelatin manufacturing process than Gelatin A (see, e.g., "Theory of the Photographic Process", Fourth Edition, Chapter 2, Ed. T. H. James, Macmillan Publishing Co., 1977). The lime processed gelatins are distinguished by their aqueous solution viscosities (designated $\eta_G$ for 10 wt % gelatin solutions at 45° C., pH 5.7), as well as their molecular weight distributions which were 10 measured by Size Exclusion Chromatography, using a TSK G4000 SW column made by Tosohaas. The weight fraction of molecules having a molecular weight greater than 150,000 for Gelatin A is 0.43 while that for Gelatin B is 0.26 and for C is 0.23. Gelatin D is an Acid Processed Ossein (APO) gel, which has a significantly lower average molecular weight than the regular lime processed Gelatin A, and a 10% aqueous solution viscosity approximately equal to that of Gelatin B.

EXAMPLE 1

Dispersion 1-1 was prepared by dissolving 44.1 g of coupler Y-1 in 30.1 g Dibutyl phthalate at 100° C. 48.9g of Gelatin A were dissolved in 296.4 g demineralized water at 80° C. 0.2 g of a 0.7% Kathon LX solution (biocide), 35.9 g of a 10% solution of Alkanol XC (a surfactant mixture of di and tri-isopropyl naphthalene sulfonate made by DuPont) and 144.3 g of a 50 nm N-tert-butylacrylamide/butylacrylate copolymer (50/50) latex (30% solids) were added to the gelatin solution while mixing at 8000 rpm with a Brinkmann rotor-stator mixer. The coupler and solvent solution was then added to the gelatin solution and mixed for 2 minutes. The resulting mixture was then homogenized at 6500 psi for 2 passes using a Microfluidics Microfluidizer at 80° C.

Dispersions 1-2 through 1-9 were prepared as dispersion 1-1, except the gelatin used was a blend of gelatins as shown in Table II below.

TABLE II

Coupler Y-1 =

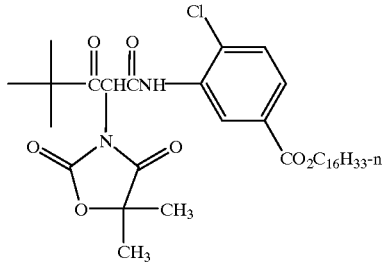

| Dispersion | pH | Gelatin Type A | B | C | D | TOT (° C.) | η (0) (Poise) | Dnirt (μm) | Comments |
|---|---|---|---|---|---|---|---|---|---|
| 1-1 | 6.21 | 100% | | 0 | | <40 | 2000 | 0.17 | Comparison |
| 1-2 | 6.02 | 75% | | 25% | | 36 | 550 | 0.17 | Comparison |
| 1-3 | 5.81 | 50% | | 50% | | 34 | 187 | 0.17 | Comparison |
| 1-4 | 5.77 | 25% | | 75% | | 32 | 87 | 0.16 | Comparison |
| 1-5 | 5.73 | 0 | | 100% | | 32 | 32 | 0.16 | Comparison |
| 1-1 | 6.21 | 100% | | | 0 | <40 | 2000 | 0.17 | Comparison |
| 1-6 | 6.18 | 75% | | | 25% | 40 | 81 | 0.17 | Invention |
| 1-7 | 6.05 | 50% | | | 50% | 42 | 21 | 0.18 | Invention |
| 1-8 | 6.06 | 25% | | | 75% | 44 | 26 | 0.18 | Invention |
| 1-9 | 6.19 | 0 | | | 100% | 46 | 27 | 0.17 | Comparison |

Dispersion 1-1 is quite viscous. Blending Gelatin A with high pI Gelatin D reduces the viscosity much more than with lower viscosity Gelatin C in the preferred ranges (1–6 vs 1–2, 1–7 vs 1–3, 1–8 vs 1–4), with little effect on particle size.

EXAMPLE 2

Dispersions 2-1 through 2-9 were prepared similarly to dispersion 1, except the gelatin used for each was a blend of gelatins as shown in Table III below.

TABLE III

| Dispersion | pH | Gelatin Type A | B | C | D | TOT (° C.) | η (0) (Poise) | Dnirt (μm) | Comments |
|---|---|---|---|---|---|---|---|---|---|
| 2-1 | 6.22 | 95% | | | 5% | <38 | 1800 | 0.15 | Invention |
| 2-2 | 6.33 | 90% | | | 10% | <38 | 850 | 0.15 | Invention |
| 2-3 | 6.12 | 85% | | | 15% | <38 | 500 | 0.16 | Invention |
| 2-4 | 6.11 | 80% | | | 20% | 38 | 320 | 0.16 | Invention |

TABLE III-continued

| Dispersion | pH | Gelatin Type A | B | C | D | TOT (° C.) | η (0) (Poise) | Dnirt (μm) | Comments |
|---|---|---|---|---|---|---|---|---|---|
| 2-5 | 6.10 | 75% | | | 25% | <42 | 170 | 0.16 | Invention |
| 2-6 | 6.10 | 70% | | | 30% | 42 | 95 | 0.16 | Invention |
| 2-7 | 6.31 | 65% | | | 35% | 44 | 68 | 0.15 | Invention |
| 2-8 | 6.12 | 60% | | | 40% | 42 | 68 | 0.16 | Invention |
| 2-9 | 6.13 | 50% | | | 50% | 42 | 35 | 0.16 | Invention |

Dispersions 2-1 through 2-8 show that as little as 5% APO gelatin can offer reduction in dispersion viscosity versus dispersion 1-1.

EXAMPLE 3

Dispersions 3-1 through 3-9 were prepared similarly as Dispersion 1-1, using gelatin types as specified in Table IV below.

TABLE IV

| Dispersion | pH | Gelatin Type A | B | C | D | TOT (° C.) | η (0) (Poise) | Dnirt (μm) | Comments |
|---|---|---|---|---|---|---|---|---|---|
| 3-1 | 6.37 | | 100% | | 0 | 36 | 76 | 0.15 | Comparison |
| 3-2 | 6.36 | | 75% | | 25% | <42 | 13.2 | 0.16 | Invention |
| 3-3 | 6.23 | | 50% | | 50% | 42 | 9.2 | 0.18 | Invention |
| 3-4 | 6.37 | | 25% | | 75% | 44 | 25 | 0.18 | Invention |
| 3-5 | 6.33 | | 0 | | 100% | 46 | 35.5 | 0.18 | Comparison |
| 3-6 | 6.21 | | | 100% | 0 | <40 | 15 | 0.15 | Comparison |
| 3-7 | 6.32 | | | 75% | 25% | 40 | 5.4 | 0.17 | Invention |
| 3-8 | 6.10 | | | 50% | 50% | 42 | 6.3 | 0.18 | Invention |
| 3-9 | 6.17 | | | 25% | 75% | 46 | 16.5 | 0.19 | Invention |
| 3-5 | 6.33 | | | 0 | 100% | 46 | 35.5 | 0.18 | Comparison |

Dispersions made with blends of low MW LPO gelatin or very low MW LPO gelatin with APO gelatin have the lowest viscosity when using 25% to 75% APO gelatin in the making of the dispersion.

EXAMPLE 4

Dispersion 4-1 was prepared by dissolving 72.7 g of coupler Y-2, 12.5 g of stabilizer A-1, and 4.2 g stabilizer A-2, in 31.8 g Diundecyl phthalate at 130° C. 48.0 g of Gelatin were dissolved in 305.4 g demineralized water at 80° C. 9.0 g of 2N Propionic acid, and 120.0 g of a 10% solution of Surf- 1 (Alkanol XC, surfactant mixture of di and tri-isopropyl naphthalene sulfonate made by DuPont) were added to the gelatin solution while mixing at 8000 rpm with a Brinkmann rotor-stator mixer. The coupler and solvent solution was then added to the gelatin solution and mixed for 2 minutes. The resulting mixture was then homogenized at 6500 psi for 2 passes using a Microfluidics Microfluidizer at 80° C.

Dispersions 4-2 through 4-5 were made as dispersion 4-1, except with gelatin blends as in Table 4. Dispersion 4-6 was made similarly as Dispersion 4-1, except that a 240.0 g of a 5% solution of Surf-2 (Sodium di(2,2-dimethyl-3-phenylprop-1-yl)sulphosuccinate, prepared in accordance with copending, commonly assigned U.S. Ser. No. 08/685,082) was used in place of the 10% solution of Surf-1, and the water used in preparing the gelatin solution was adjusted accordingly to maintain the same gelatin concentration. Dispersions 4-7 and 4-8 were made as dispersion 4-6, varying the gelatin as in Table V below.

TABLE V

Coupler Y-2 =

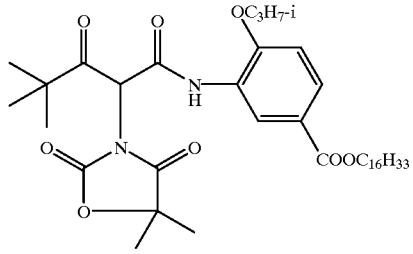

Stabilizer A-1 =

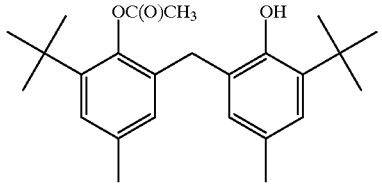

Stabilizer A-2 =

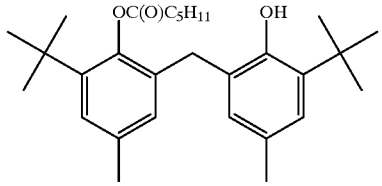

| | | | Gelatin Type | | TOT | η (0) | Dnirt | |
|---|---|---|---|---|---|---|---|---|
| Dispersion | pH | Surfacant | B | D | (° C.) | (Poise) | (μm) | Comments |
| 4-1 | 5.29 | Surf-1 | 100% | 0 | 38 | 18.1 | 0.15 | Comparison |
| 4-2 | 5.21 | Surf-1 | 75% | 25% | 42 | 13.6 | 0.16 | Invention |
| 4-3 | 5.23 | Surf-1 | 50% | 50% | 44 | 9.4 | 0.18 | Invention |
| 4-4 | 5.13 | Surf-1 | 25% | 75% | 46 | 22.3 | 0.18 | Invention |
| 4-5 | 5.05 | Surf-1 | 0 | 100% | 46 | * | 0.18 | Comparison |
| 4-6 | 5.28 | Surf-2 | 100% | 0 | 40 | 19.3 | 0.15 | Comparison |
| 4-7 | 5.2 | Surf-2 | 50% | 50% | 44 | 6.9 | 0.18 | Invention |
| 4-8 | 5.06 | Surf-2 | 0 | 100% | 46 | 9.3 | 0.18 | Comparison |

*Unstable dispersion

With either surfactant, blending gelatin B with gelatin D allows for lower dispersion viscosity.

The invention has been described in detailed with particular reference to preferred embodiments thereof, but it is to be understood that variations and modifications can be effected within the spirit and scope of the invention.

What is claimed is:

1. A process for making a direct dispersion of a photographically useful material comprising: mixing (i) an aque ous phase comprising a gelatin solution and (ii) a liquid organic phase comprising a photographically useful material under conditions of high shear or turbulence to form a fine dispersion of the organic phase having an average particle size of less than 0.5 micron dispersed in the aqueous phase; wherein the gelatin solution comprises a mixture of a first gelatin having an isoelectric point pH of less than or equal to 5.2 and a second gelatin having an isoelectric point pH of greater than or equal to 6.0.

2. The process of claim 1, wherein essentially no volatile or water-miscible organic solvent is present in the organic phase.

3. The process of claim 2, wherein the organic phase comprises at least 16 weight percent of the dispersion.

4. The process of claim 2, wherein the organic phase comprises at least 17 weight percent of the dispersion.

5. The process of claim 2, wherein the organic phase comprises at least 18 weight percent of the dispersion.

6. The process of claim 1, wherein the first gelatin has an pI of from 4.8–5.1.

7. The process of claim 1, wherein the second gelatin has an pI of from 6.0–9.5.

8. The process of claim 1, wherein the second gelatin has an pI of from 6.0–8.0.

9. The process of claim 1, wherein the first gelatin comprises a lime processed ossein (LPO) gelatin.

10. The process of claim 9, wherein the first gelatin exhibits a solution viscosity of at least 4.0 cP, measured as a 10 wt % aqueous solution at a temperature of 45° C. and a pH of 5.7.

11. The process of claim 9, wherein the first gelatin exhibits a solution viscosity of at least 7.0 cP, measured as a 10 wt % aqueous solution at a temperature of 45° C. and a pH of 5.7.

12. The process of claim 9, wherein the first gelatin exhibits a solution viscosity of at least 12.0 cP, measured as a 10 wt % aqueous solution at a temperature of 45° C. and a pH of 5.7.

13. The process of claim 12, wherein the first gelatin comprises greater than 40% by weight of molecules having a molecular weight greater than 150,000 daltons.

14. The process of claim 9, wherein the first gelatin comprises a decalcified lime processed ossein gelatin.

15. The process of claim 1, wherein the second gelatin comprises an acid processed gelatin.

16. The process of claim 15, wherein the second gelatin exhibits a solution viscosity of less than or equal to about 150% of the solution viscosity of the first gelatin, wherein the viscosity of each gelatin is measured as 10 wt % aqueous solutions at a temperature of 45° C. and a pH of 5.7.

17. The process of claim 15, wherein the second gelatin exhibits a solution viscosity of less than or equal to about 100% of the solution viscosity of the first gelatin, wherein the viscosity of each gelatin is measured as 10 wt % aqueous solutions at a temperature of 45° C. and a pH of 5.7.

18. The process of claim 15, wherein the second gelatin is an acid processed ossein (APO) gelatin having an pI of from 6.0–7.5.

19. The process of claim 1, wherein the weight ratio of the first gelatin to the second gelatin is from about 1:3 to 20:1.

20. The process of claim 1, wherein the weight ratio of the first gelatin to the second gelatin is from about 1:1 to 10:1.

21. The process of claim 1, wherein the weight ratio of the first gelatin to the second gelatin is from about 1:1 to 3:1.

22. The process of claim 1, wherein the second gelatin comprises less than 50 weight percent of the total gelatin.

23. The process of claim 1, wherein the dispersion further comprises dispersed polymer latex particles.

24. The process of claim 1, wherein the a polymer latex dispersion is mixed with the gelatin solution and liquid organic phase under high shear or turbulence.

* * * * *